US006703122B2

(12) United States Patent
Zhou et al.

(10) Patent No.: US 6,703,122 B2
(45) Date of Patent: Mar. 9, 2004

(54) HIGH-STRENGTH CHEMICALLY RESISTANT THIN SHEATH FIBERS AND METHODS OF MANUFACTURE

(76) Inventors: Qiang Zhou, 11412 Laurel Top Pl., Midlothian, VA (US) 23113; Alexander Lobovsky, 16 Delwick La., New Providence, NJ (US) 07974; James Matrunich, 248 Old Tote Rd., Mountainside, NJ (US) 07092; Conor Twomey, 6001 Sedgefield Ter., Midlothian, VA (US) 23112; Barbara McGrath, 1502 Westover Hills Blvd., Richmond, VA (US) 23225

( * ) Notice: Subject to any disclaimer, the term of this patent is extended or adjusted under 35 U.S.C. 154(b) by 15 days.

(21) Appl. No.: 10/186,855

(22) Filed: Jul. 1, 2002

(65) Prior Publication Data

US 2003/0049442 A1 Mar. 13, 2003

Related U.S. Application Data

(60) Provisional application No. 60/303,103, filed on Jul. 3, 2001.

(51) Int. Cl.[7] ..... D01F 8/00

(52) U.S. Cl. ..... 428/370; 428/373; 428/374; 525/199

(58) Field of Search ..... 428/370, 373, 428/374; 525/199; 606/228

(56) References Cited

U.S. PATENT DOCUMENTS

| | | | | |
|---|---|---|---|---|
| 3,716,317 A | | 2/1973 | Williams, Jr. et al. | 425/198 |
| 4,358,375 A | | 11/1982 | Wood | 425/199 |
| 4,406,850 A | | 9/1983 | Hills | 425/131.5 |
| 5,505,889 A | | 4/1996 | Davies | 264/173.16 |
| 5,562,930 A | | 10/1996 | Hills | 425/198 |
| 5,618,479 A | | 4/1997 | Lijten et al. | 264/103 |
| 5,827,611 A | | 10/1998 | Forbes | 428/375 |
| 6,027,592 A | * | 2/2000 | Tseng et al. | 156/167 |
| 6,174,601 B1 | * | 1/2001 | Stanitis et al. | 428/373 |
| 6,174,603 B1 | | 1/2001 | Berger | 428/373 |
| 6,183,499 B1 | * | 2/2001 | Fischer et al. | 606/228 |
| 6,433,093 B2 | * | 8/2002 | Lee et al. | 525/199 |

FOREIGN PATENT DOCUMENTS

| | | | |
|---|---|---|---|
| EP | 011954 | 8/1982 | D01D/4/02 |

* cited by examiner

*Primary Examiner*—N. Edwards
(74) *Attorney, Agent, or Firm*—Rutan & Tucker

(57) ABSTRACT

Compositions and methods are directed to a sheath core fiber with a core and a sheath that comprises a fluoropolymer. Contemplated sheath materials include PVDF, ECTFE, and ETFE, and may have an apparent shear viscosity equal to or less than the apparent shear viscosity of the core material. Especially contemplated sheaths have a weight of 30% or less of the weight of the fiber. Preferred fibers are spun in a spin pack having a sheath material conduit with a ratio of open volume to sheath material mass flow of less than 0.75 for a fiber with a 30 wt % sheath, of less than 1.15 for a fiber with a 20 wt % sheath, and of less than 2.30 for a fiber with a 10 wt % sheath

13 Claims, 2 Drawing Sheets

Core : 70%
Sheath : 30%

Core : 80%
Sheath : 20%

Core : 90%
Sheath : 10%

HIGH-STRENGTH CHEMICALLY RESISTANT THIN SHEATH FIBERS AND METHODS OF MANUFACTURE

CROSS-REFERENCE TO RELATED APPLICATION

This application claims priority to pending U.S. provisional application serial No. 60/303,103, filed Jul. 3, 2001, the entire contents of which are incorporated by reference.

FIELD OF THE INVENTION

The field of the invention is multi-component thin sheath fibers.

BACKGROUND OF THE INVENTION

Multi-component fibers have found numerous applications in various products, including carpet fibers, fibers that are exposed to mechanical stress and fibers that are exposed to environmental stress, and among such fibers, sheath core fibers (i.e., fibers with a core that is surrounded by a sheath) can in many cases be manufactured in relatively large scale. However, production of such fibers becomes increasingly difficult as the thickness of the sheath decreases.

For example, decreasing sheath thickness frequently leads to inhomogeneity of the overall sheath thickness in various sheath core fibers. One approach to reduce inhomogeneity of a sheath is described in EP 0 011 954 B1 to Perkin, disclosing a configuration and spinning conditions that increase the degree of homogeneity of sheath thickness within and among a population of fibers. Although Perkin's spinning apparatus improves the degree of homogeneity (e.g., approximately 15% of the fibers have the desired sheath content of 15% while the sheath content of the remaining fibers varies between 5% and 15% and 15% and 30%), sheath homogeneity still remains problematic.

In another approach, Lijten et al. employ a process in which at least in the area surrounding the stream of a core component the sheath component is subjected to a flow resistance as described in U.S. Pat. No. 5,618,479. Although Lijten's process significantly improves homogeneity of sheath thickness as compared to Perkin's fibers, homogeneity of sheath thickness still remains problematic, especially where the sheath thickness is less than 10% (e.g., 60% of fibers have a sheath content of 9%±1%).

A further problem of known spinning processes for production of sheath core fibers is that such processes typically limit the choice of materials to polymers with substantially similar rheological properties. Consequently, many sheath core fibers employ the same or almost the same polymeric material, which may then be modified with an additive to impart a particularly desirable characteristic into the fiber (see e.g., U.S. Pat. No. 6,174,603 to Berger, or U.S. Pat. No. 5,827,611 to Forbes). Among various other characteristics, resistance to solvents and other relatively aggressive chemical agents is often particularly desirable. In one approach, a particularly desirable characteristic may be imparted into the fiber by incorporating relatively large quantities of an additive into the fiber. However, relatively high concentrations often reduce tenacity and/or other mechanical properties.

Alternatively, the fiber may be surface-coated with the additive to achieve a particularly high concentration of the additive on the fiber. While coating typically allows introducing substantial amounts of the additive onto the fiber, coatings are generally prone to abrasion. To overcome at least some of the problems associated with abrasion, the surface of a fiber may be chemically derivatized to couple the additive to the fiber surface. Although chemical surface modification often improves abrasion resistance, chemical surface modification may alter one or more physico-chemical surface properties, thereby potentially interfering with subsequent production steps.

Although various sheath-core fibers are known in the art, all or almost all of them suffer from one or more problems, especially as the thickness of the sheath decreases. Thus, there is still a need to provide improved sheath core fibers.

SUMMARY OF THE INVENTION

The present invention is directed to methods and compositions for sheath core fibers with a core formed from a core material and a sheath formed from a sheath material comprising a fluoropolymer, wherein the sheath at least partially surrounds the core.

In one aspect of the inventive subject matter, the sheath material has a apparent shear viscosity $V_S$ that is equal to or less than the apparent shear viscosity of the core material $V_C$, wherein $V_C$ is at least 1.3 times $V_S$, and more preferably at least 1.6 times $V_S$. Further preferred sheath materials include melt-processable fluoropolymers, and especially contemplated fluoropolymers are poly(vinylidene fluoride) (PVDF), ethylene-chloro-tri-fluoro-ethylene (ECTFE), and ethylene-tetrafluoro-ethylene (ETFE).

In another aspect of the inventive subject matter, contemplated core materials comprise an organic polymer, preferably poly(ethylene terephthalate) (PET), poly(ethylene naphthalate) (PEN), a polyamide, or a polyolefin. The core of particularly preferred sheath core fibers is at least 70 wt %, more preferably at least 80 wt %, and most preferably at least 90 wt % of the fiber.

In a still further aspect of the inventive subject matter, a method of producing a fiber has one step in which a core material, and a sheath material that comprises a melt-processable fluorine-containing polymer are provided. In a still further step, a spin pack is provided and a sheath core fiber with a sheath and a core is formed from the sheath material and the core material using the spin pack, wherein the sheath at least partially surrounds the core. In especially contemplated fibers and methods, the core has a weight $W_C$, the sheath has a weight $W_S$, $W_S/W_C$ is no higher than 0.43, more preferably no higher than 0.25, and most preferably no higher than 0.12, and the spin pack has a sheath material conduit having a ratio of open volume to sheath material mass flow of equal or less than 1.13, 1.7, or 3.4, respectively.

Various objects, features, aspects and advantages of the present invention will become more apparent from the following detailed description of preferred embodiments of the invention, along with the accompanying drawing.

DETAILED DESCRIPTION

The inventors have discovered that multi-component thin sheath fibers can be spun in which the core material is significantly different from the sheath material. For example, the core material may be structurally and physico-chemically distinct from the sheath material molecules such that the apparent shear viscosity, average molecular weight, and/or chemical resistance to organic and inorganic solvents, acids, and bases significantly distinct.

In a particularly preferred aspect of the inventive subject matter, a fiber is spun from PET as core material and PVDF as sheath material, wherein the core material accounts for about 90 wt % of the fiber and the PVDF accounts for about 10 wt % of the fiber. It is further contemplated that preferred fibers are spun in a spin pack with a sheath material conduit at a ratio of open volume to sheath material mass flow of equal or less than 3.40, and that the core and the sheath of contemplated fibers are spun in the same spin pack.

With respect to the core material, it should be appreciated that numerous materials other than PET are also contemplated, and suitable materials include all known melt-extrudable polymers. However, particularly preferred alternative core materials include aromatic polyesters (e.g., PEN), polyamides (e.g., Nylon 6 and Nylon 66), various polyolefins (e.g., polyethylene, polypropylene, etc.), and all reasonable combinations thereof Furthermore, it should be appreciated that contemplated core materials may further include additives, which may enhance or modify one or more physico-chemical properties. Especially contemplated additives include dyes, UV-absorbing agents, flame retardants, electrically conductive additives, adhesion enhancers, lubricants, and additives that influence an optical property.

Figure 1A:
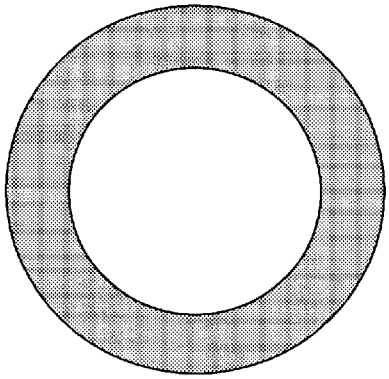
FIGS. 1A–1C are schematic horizontal cross sections of exemplary fibers.
Figure 1B:
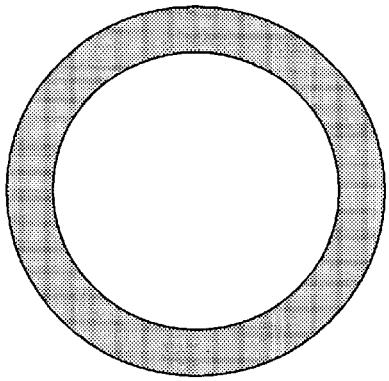
Figure 1C:
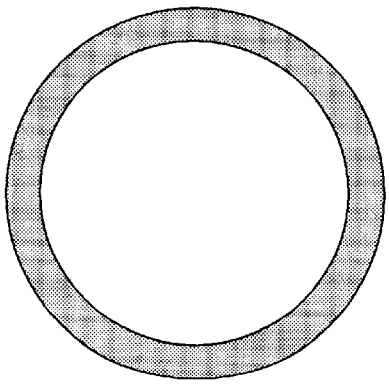

In further contemplated aspects of the inventive subject matter, suitable fibers may have a core to sheath ratio of other than 90 wt % to 10 wt %. For example, contemplated fibers may have a core that is between about 50 wt % (inclusive) and 80 wt % (inclusive) of the fiber, preferably between 80 wt % (inclusive) and 90 wt % (inclusive), and even more preferably between 90 wt % (inclusive) and 97 wt % (inclusive), and exemplary horizontal cross sections of suitable fibers are depicted in FIGS. 1A–1C. Furthermore, it should be appreciated that a particular configuration of suitable fibers is not limiting to the inventive subject matter, and contemplated fiber configurations include concentric, eccentric, and trilobal configurations, etc.

With respect to the sheath material it should be appreciated, that all known organic polymers for spinning are appropriate. However, particularly preferred sheath materials include melt-extrudable fluorine-containing polymers (e.g., PVDF, ECTFE, and ETFE). It should further be appreciated that contemplated sheath materials may also be mixtures of melt-extrudable fluorine-containing polymers, or mixtures of melt-extrudable fluorine-containing polymers with non-fluorinated melt-extrudable polymers. For example, an appropriate sheath material may comprise 40 wt % ECTFE and 60 wt % ETFE. Alternatively, and especially where a relatively low fluorine content is desirable, suitable sheath materials may comprise a mixture of 80 wt % PET and 20 wt % ETFE. Still further contemplated sheath materials may further include one or more additives, and appropriate additives are the same as contemplated additives for the core material described above.

Depending on the particular amount of core material, the sheath of contemplated fibers may vary considerably. Thus, contemplated sheaths will typically be in the range of between 20 wt % to 50 wt % (and more), more typically in the range of between 20 wt % to 10 wt %, and even more typically in the range of between 10 wt % to 5 wt % (and even less). Consequently, it is contemplated that the core in suitable fibers has a weight $W_C$, the sheath has a weight $W_S$, and $W_S/W_C$ is no higher than 0.43, more preferably no higher than 0.25, and most preferably no higher than 0.12. While it is generally preferred that the sheath of contemplated fibers completely surrounds the core along the entire length of the fiber, it is also contemplated that the sheath only partially surrounds the core. For example, where the fiber has an eccentric configuration, it is contemplated that a portion of the core may coincide with the surface of the fiber. Alternatively, the fiber may be spun with a discontinuous sheath, thereby exposing at least part of the core in one or more portions of the fiber.

In a further preferred aspect of the inventive subject matter, contemplated fibers are spun in a spin pack in which (a) the residence time of the sheath material is significantly reduced, and/or in which (b) the sheath material is passed from the cap portion to the spinneret under conditions that significantly reduce thermal degradation of the sheath material, and/or in which (c) the core material and the sheath material may have significantly distinct rheological properties.

Figure 2:
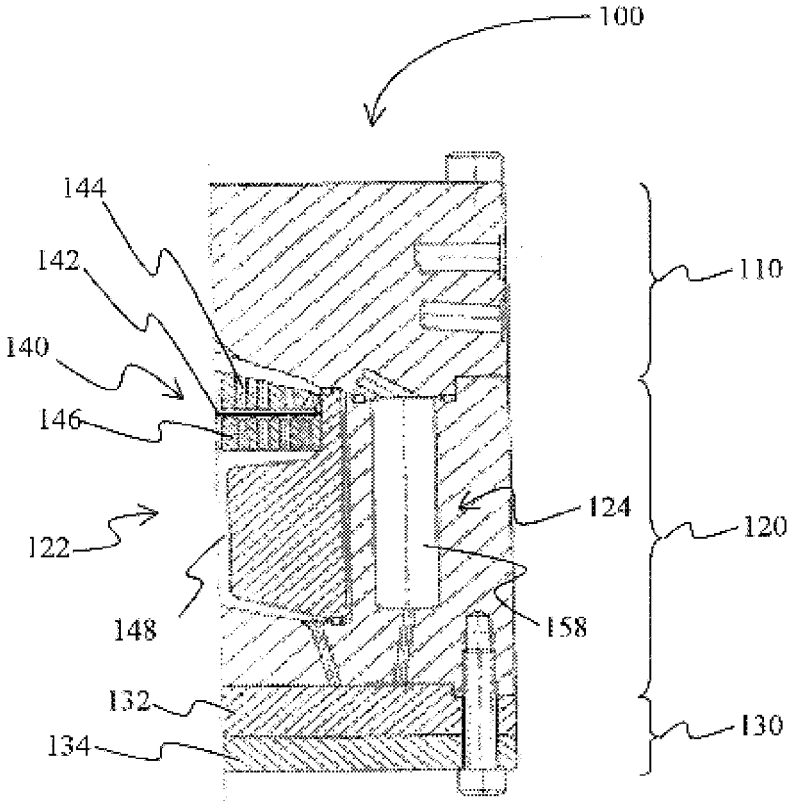
FIG. 2 is a vertical cross section of a schematic of an exemplary spin pack with a sheath material conduit having a ratio of open volume to sheath material mass flow of less than 1.13 at a configuration for spinning sheath core fibers with a weight ratio of sheath to core of no higher than 0.43.

FIG. 2 depicts a partial view of a vertical cross section of an exemplary spin pack 100 that includes a cap portion 110, a distribution/filtration element 120, and a spinneret portion 130. The distribution/filtration element 120 comprises a cavity 122 that receives the sheath material. Disposed within the cavity 122 is a filter unit 140 with a filter pack 142, which is retained between a distribution element 144 and a guide 146. The space filled by the sheath material when the sheath material is passed through the distribution/filtration element defines the sheath material conduit 148, a portion of which is centrally located (with respect to a horizontal cross section of the spin pack). The distribution/filtration element 120 further comprises a cavity 124 that receives the core material. Disposed within the cavity 124 is a filter unit (not shown) with a filter pack that is retained between a distribution element and a guide. The space filled by the core material when the core material is passed through the distri-bution/filtration element defines the core material conduit 158. The spinneret portion 130 has a top plate 132 that receives both filtered sheath material and filtered core material, and that provides the bottom plate 134 with a defined flow of core material and the filtered sheath material for formation of the sheath around the defined flow of core material. Bottom plate 134 distributes the filtered sheath material through a network of flow channels to the areas of defined flow of core material to form the sheath around the core.

With respect to the cap portion it is contemplated that all known cap portions are suitable for use in conjunction with contemplated distribution/filtration elements, so long as the cap portion provides a feed of sheath material and core material to the distribution/filtration element. For example, appropriate cap portions are described in U.S. Pat. No. 3,716,317 to Williams et al., and U.S. Pat. No. 4,406,850 to Hills, both of which are incorporated by reference herein. However, it is generally preferred that the cap portion is configured such that the sheath material travels a relatively short distance from the extruder in a uniform flow pattern (i.e., without stagnant zones), and that the sheath material and the core material are delivered to their respective filter units in the distribution/filtration element. For example, where appropriate, the sheath material may be introduced via the top portion of the cap. Alternatively, the sheath material may be introduced into the cap portion through a sidewall.

A particularly preferred distribution/filtration element includes at least two cavities (each of the cavities having a filter unit) that receive molten core material from the cap portion. These cavities are preferably disposed in a peripheral position (relative to the longitudinal axis) of the spin pack, and fluidly coupled to an opening that delivers the filtered molten and filtered core material to the (top plate of the) spinneret. However, in alternative aspects of the inventive subject matter, more than two cavities are also contemplated which may or may not be disposed in a peripheral position of the spin pack. For example, where the spin packs are relatively large, such spin packs may include 3–6, and even more cavities to receive molten core material from the cap portion.

Preferred distribution/filtration elements further include at least one cavity that receives molten sheath material from the cap portion, and that further includes a filter unit as depicted in FIG. 2. This cavity (that receives molten sheath material) is preferably disposed in a substantially centered position within the distribution/filtration element, and is fluidly coupled to one or more openings that deliver the filtered molten sheath material to the (top plate of the) spinneret. In alternative aspects of the inventive subject matter, more than one cavity is also contemplated which may or may not be disposed in a substantially centered position of the spin pack. For example, where the spin packs are relatively large, such spin packs may include 2–4, and even more cavities centered round the geometric center (in a horizontal cross section) of contemplated distribution/filtration elements.

The filter unit for the molten sheath and/or core material preferably comprises a filter pack with an inert filter material, which is retained between a pair of screens and covers as described in U.S. Pat. No. 4,358,375 to Wood (infra). The filter pack is preferably disposed between a distribution element (on top of the filter pack as shown in FIG. 2) and a guide (below the filter pack as shown in FIG. 2) that receives the filtered core material and delivers the filtered core material to an opening that is in fluid communication with the (top plate of the) spinneret. However, in alternative aspects of the inventive subject matter, various configurations other than the configurations previously described are also suitable. For example, the filter unit need not necessarily be restricted to a filter pack, but may also include a candle-type filter. Furthermore, suitable filter units need not include a guide that receives the filtered core material.

There are numerous filters for filtration of molten core materials known in the art, and all of the known filters are generally contemplated suitable for use in conjunction with the teachings presented herein. Appropriate filters and filter materials are described in U.S. Pat. No. 4,358,375 to Wood (filter packs), or U.S. Pat. No. 4,406,850 to Hills (filter screens), and in the article entitled "Spin Pack Problems" by W. H. Hills, which appeared in the April, 1978 issue of the "Fiber Producer" trade journal, all of which are incorporated by reference herein. However, particularly preferred filter units include a filter pack with screens of metal wires as inert filter material and generally have a width to height ratio of at least 2, more preferably at least 3, and most preferably at least 5.

It should be especially recognized that the sheath material conduit forms path through which the filtered sheath material is passed through to the spinneret. At least a portion of this path has a substantially centered position within the distribution/filtration element. The term "substantially centered position [of a path or conduit] within the distribution/filtration element" as used herein refers to a position of the path or conduit in which the geometric center (in a horizontal cross section) of the path or conduit is no more than two times the widest inner diameter of the path or conduit away from the geometric center (in a horizontal cross section) of the distribution/filtration element. For example, the flow path of contemplated sheath material conduits may be in a substantially centered position within the distribution/filtration element. On the other hand, at least a portion of the flow path of contemplated sheath material conduits may also be in an eccentric position within the distribution/filtration element It should further be especially appreciated that the sheath material conduit has a ratio of open volume to core material mass flow of no more than 3.4 at a sheath content in a fiber of 10 wt %. The term "open volume of the sheath material conduit" as used herein refers to the volume that receives molten sheath material from the cap portion. As viewed from another perspective, the open volume of the sheath material conduit equals the volume of molten sheath material within the sheath material conduit. The term "sheath material conduit" refers to the space that is filled by the sheath material when the sheath material is passed through the distribution/filtration element. The term "sheath material mass flow" as used herein refers to the mass of molten sheath material (in gram) passing through the distribution/filtration element per time interval (in minutes). In alternative aspects of the inventive subject matter, suitable sheath material conduits may be configured to have a ratio of dead volume to sheath material mass flow of no more than 1.7 at a sheath content in a fiber of 20 wt %, no more than 1.2 at a sheath content in a fiber of 30 wt %, no more than 0.9 at a sheath content in a fiber of 40 wt %, and/or no more than 0.7 at a sheath content in a fiber of 50 wt %, In a further particularly contemplated aspect of the inventive subject matter, contemplated fibers are spun from a spin pack comprising a distribution/filtration element with a sheath material conduit, a core material conduit, and a filter at least partially disposed within the sheath material conduit, wherein the sheath material conduit is configured to have a ratio of open volume to sheath material mass flow as indicated below:

| Wt % Sheath | 10 | 20 | 30 | 40 | 50 |
|---|---|---|---|---|---|
| Open Sheath Volume ($cm^3$) | 47.03 | 47.03 | 47.03 | 47.03 | 47.03 |
| Mass flow rate ($cm^3$/min) | 13.82 | 27.65 | 41.47 | 55.30 | 69.12 |
| Ratio of open volume to mass flow | 3.40 | 1.70 | 1.13 | 0.85 | 0.68 |

In a graphical representation, particularly preferred sheath material conduits are configured to have a quotient of [ratio of open volume to sheath material mass flow]/[wt % of the sheath] that lies below the curve (which is represented by the equation $y=34.021x^{-1}$) as depicted in FIG. 4.

With respect to the spinneret it should be appreciated that all known spinnerets known in the art are suitable for use in conjunction herein, so long as contemplated spinnerets produce multi-component fibers, and preferably thin sheath fibers. For example, suitable spinnerets and configurations therefor are described in U.S. Pat. No. 5,562,930 to Hills, U.S. Pat. No. 5,618,479 to Lijten et al., and U.S. Pat. No. 5,505,889 to Davies, all of which are incorporated by reference herein. However, it is generally preferred that the spinneret produces a thin sheath fiber wherein the sheath is no more than 30 wt % of the weight of the fiber, more preferably no more than 20 wt % of the weight of the fiber, and most preferably no more than 10 wt % of the weight of the fiber.

It should be particularly appreciated that the residence time and/or ratio of open volume to mass flow (for the sheath material) in contemplated spin packs is sufficiently low to significantly improve the spinning process and at least some of the physicochemical properties of multi-component fibers produced with such spin packs. For example, the sheath material and the core material spun in contemplated spin packs may have significantly different rheological properties. In one particularly advantageous aspect, it is contemplated that configurations and processes according to the inventive subject matter allow spinning of multi-component fibers in which the core material and the sheath material have significantly distinct melt viscosity. For example, contemplated fibers may include poly(ethylene terephthalate) as core material with an apparent shear viscosity of 4,050 poise at a temperature of 280° C. and shear rate of 100 $sec^{-1}$, while poly(vinylidene fluoride) as sheath material has an apparent shear viscosity of 3,020 poise at the same temperature and shear rate. In further examples, it is contemplated that the core material may have an apparent shear viscosity that is at least 1.15, more preferably at least 1.3, even more preferably at least 1.6, and most preferably at least 1.7 times the apparent shear viscosity of the sheath material at a temperature of 280° C. and shear rate of 100 $sec^{-1}$.

It is generally preferred that the residence time of the sheath material in contemplated spin packs is effectively and significantly reduced by providing a sheath material conduit having a ratio of open volume to sheath material mass flow of no more than 3.4 at a sheath content in the fiber of 10 wt %, and by disposing at least a portion of the sheath material conduit in a substantially centered position within the distribution/filtration element. However, in alternative aspects of the inventive subject matter, it should also be appreciated that active and/or passive thermal control mechanisms may be implemented.

For example, active thermal control elements may include heating and/or cooling circuits, and especially contemplated active thermal control elements include heating and/or cooling coils, elements, or radiators which may be disposed within the spin pack or be placed proximal to the spin pack. Such active thermal control elements may be operated by numerous mechanisms, and particularly contemplated mechanisms include convection (e.g., with heated oil or other heating/cooling fluid) and electric heating/cooling (e.g., via electric heating coil or peltier element). It is further contemplated that active thermal control elements may be located to selectively heat or cool at least one of the sheath material conduit and core material conduit, and that therefore the temperature of the sheath material and/or the core material can be individually controlled.

Passive thermal control elements may include various insulation elements, which may be placed to selectively insulate at least one of the sheath material conduit and core material conduit. There are numerous passive thermal control elements known in the art, and particularly contemplated thermal control elements include layers or discrete elements comprising mineral wool, foamed organic or inorganic materials, etc.

Figure 3:
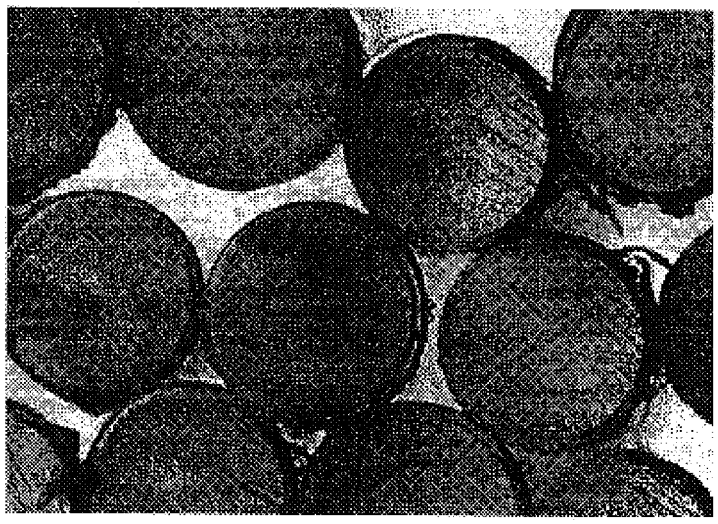
FIG. 3 is a horizontal cross section of multiple thin sheath fibers spun with a spin pack according to the inventive subject matter.

Thus, it is contemplated that multi-component fibers produced with contemplated spin packs, and especially thin sheath fibers, will have (1) a substantially constant thickness of the sheath throughout the entire length of the fiber, and (2) a substantially constant thickness of the sheath among all fibers. The term "substantially constant thickness" as used herein means that the thickness of the sheath will vary no more than 30%, more preferably no more than 20%, even more preferably no more than 10%, and most preferably no more than 5%. A typical horizontal cross section of multiple thin sheath fibers (85% PET core, 15% PVDV sheath) spun with a spin pack according to the inventive subject matter is depicted in FIG. 3.

Consequently, it is contemplated that method of producing a fiber comprises a step in which a core material and a sheath material comprising a melt-processable fluorine-containing polymer are provided. In a further step, a spin pack is provided, and a sheath core fiber is spun from the core material and the sheath material using the spin pack, wherein the sheath at least partially surrounds the core. With respect to the fiber, the core and sheath material, and the spin pack, the same considerations as described above apply.

It should be especially appreciated that fibers according to the inventive subject matter have particular industrial usefulness in all or almost all applications where such fibers are exposed to a chemically corrosive environment. For example, contemplated fibers exhibit significantly improved resistance towards acids and bases (infra). Furthermore, it should be appreciated that contemplated fibers also exhibit improved resistance to reactive agents other than acids and/or bases, and especially contemplated reactive agents include peroxides, radicals, etc.

It is further contemplated that fibers according to the inventive subject matter may also be included into numerous fiber-containing products. For example, contemplated fibers may be formed into fiber products, including yarns, cords, or fabric, which may further comprise additional fibers. In a still further example, contemplated fibers and fiber products may be incorporated into natural (e.g., rubber) and/or synthetic polymers (e.g., organic resins) as reinforcing or structural materials.

EXAMPLES

The following examples are provided to illustrate various aspects of the inventive subject matter presented herein. In particular, the examples describe exemplary parameters for contemplated distribution/filtration elements, core- and sheath materials, and methods and properties of fibers produced using contemplated spin packs.

Spinning of Thin Sheath Fibers

The thin sheath fibers were produced using various fluorine-containing melt-processable polymers as the sheath material and PET chips as the core material. The extrusion temperature for the sheath was set from 200° C. to 285° C. and the extrusion temperature for the core was set from 260° C. to 285° C. The spin block temperature was set at 285° C. Unless specified otherwise, the main process conditions are as follows: Total throughput per spinneret: 32 pounds per hour, number of filaments: 136; take-up speed: 450 meter per minute; 1st draw roll temperature: 90° C.; 2nd draw roll temperature: 160° C.; total draw ratio: 4.8; target denier: 1000.

Chemical Resistance of Exemplaty Fibers to Various Agents

Fibers (PET control, and sheath core fiber with 90 wt % PET core and 10 wt % PVDF sheath) were spun according to the protocol provided above, and various fiber parameters were determined as listed in Table 1 below:

TABLE 1

| Fiber | Wt % of Sheath | Sheath Material | Wt % of Core | Core Material | Original Denier | Number of Filaments | Denier per filament | Original Elongation to break (%) | Original Tenacity (g/d) |
|---|---|---|---|---|---|---|---|---|---|
| PET Control | 0 | n/a | 100 | PET | 950 | 136 | 7.0 | 12.2 | 5.11 |
| PVDF/PET Sheath/Core | 10 | PVDF (Hylar) | 90 | PET | 950 | 136 | 7.0 | 14.1 | 5.17 |

The fibers were then subjected to immersion exposure at ambient temperature (approximately 21° C.) in various agents, including acid and base, and selected fiber parameters were determined using standard protocols. Tables 2–4 list some of the fiber parameters after exposure in the agents for times as indicated.

TABLE 2

| Description | Test Chemical1 | Test Length (days) | Retained Elongation to break (%) | Retained Tenacity (g/d) | Elongation Retention (%) | Tenacity Retention (%) |
|---|---|---|---|---|---|---|
| PET Control | 10% HCL | 7 | 6.3 | 3.55 | 51.4 | 69.4 |
| PVDF/PET Sheath/Core | 10% HCL | 7 | 11.2 | 4.42 | 79.4 | 85.4 |

TABLE 3

| Description | Test Chemical 2 | Test Length (days) | Retained Elongation to break (%) | Retained Tenacity (g/d) | Elongation Retention (%) | Tenacity Retention (%) |
|---|---|---|---|---|---|---|
| PET Control | 10% NaOH | 2 | 5.1 | 1.03 | 41.6 | 20.1 |
| PVDF/PET Sheath/Core | 10% NaOH | 2 | 6.5 | 2.34 | 46.1 | 45.3 |

TABLE 4

| Description | Test Chemical 3 | Test Length (day) | Retained Elongation to break (%) | Retained Tenacity (g/d) | Elongation Retention (%) | Tenacity Retention (%) |
|---|---|---|---|---|---|---|
| PET Control | $H_2SO_4$ | 7 | 10.0 | 4.70 | 81.6 | 91.9 |
| PVDF/PET Sheath/Core | $H_2SO_4$ | 7 | 14.1 | 5.20 | 100.0 | 100.5 |

Therefore, it should be appreciated that sheath core fibers according to the inventive subject matter have a significantly improved retention of elongation and tenacity after exposure to various chemical agents.

Thus, specific embodiments and applications of modified spin packs for thin sheath fibers have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A fiber comprising:

a core that is formed from a core material, and a sheath that is formed from a sheath material and at least partially surrounds the core, wherein the sheath material comprises a fluoropolymer; and wherein the sheath material has an apparent shear viscosity $V_S$ that is equal to or less than an apparent shear viscosity of the core material $V_C$.

2. The fiber of claim 1 wherein $V_C$ is at least 1.3 times $V_S$.

3. The fiber of claim 1 wherein $V_C$ is at least 1.6 times $V_S$.

4. The fiber of claim 1 wherein the core has a weight $W_C$, the sheath has a weight $W_S$, and wherein $W_S/W_C$ is no higher than 0.43

5. The fiber of claim 1 wherein the core has a weight $W_C$, the sheath has a weight $W_S$, and wherein $W_S/W_C$ is no higher than 0.12.

6. The fiber of claim 1 wherein the core material comprises a polymer selected from the group consisting of a poly(ethylene terephthalate), a poly(ethylene naphthalate), a polyamide, and a polyolefin.

7. The fiber of claim 6 wherein the core material comprises poly(ethylene terephthalate).

8. The fiber of claim 1 wherein the sheath material comprises a melt-processable fluoropolymer.

9. The fiber of claim 8 wherein the melt-processable fluoropolymer is selected from the group consisting of poly(vinylidene fluoride), ethylene-chloro-tri-fluoro-ethylene, and ethylene-tetrafluoro-ethylene.

10. The fiber of claim 1 wherein the core material comprises poly(ethylene terephthalate) and the sheath material comprises poly(vinylidene fluoride).

11. The fiber of claim 1 wherein the core has a weight $W_C$, the sheath has a weight $W_S$, $W_S/W_C$ is no higher than 0.43, and wherein the sheath is formed in a spin pack with a sheath material conduit at a ratio of open volume to sheath material mass flow of no more than 1.13.

12. The fiber of claim 1 wherein the core has a weight $W_C$, the sheath has a weight $W_S$, $W_S/W_C$ is no higher than 0.25, and wherein the sheath is formed in a spin pack with a sheath material conduit at a ratio of open volume to sheath material mass flow of no more than 1.7.

13. The fiber of claim 1 wherein the core has a weight $W_C$, the sheath has a weight $W_S$, $W_S/W_C$ is no higher than 0.12, and wherein the sheath is formed in a spin pack with a sheath material conduit at a ratio of open volume to sheath material mass flow of no more than 3.4.

* * * * *